United States Patent [19]

Wangard et al.

[11] 4,208,939

[45] Jun. 24, 1980

[54] DATA ENCODER FOR AN ELECTRONIC MUSICAL INSTRUMENT

[75] Inventors: William Wangard, Melrose Park; David T. Starkey, Oak Park, both of Ill.

[73] Assignee: Norlin Industries, Inc., Lincolnwood, Ill.

[21] Appl. No.: 25,880

[22] Filed: Apr. 2, 1979

[51] Int. Cl.[2] ..... G10H 1/00; G10H 5/10

[52] U.S. Cl. ..... 84/1.17; 84/1.13; 84/1.26; 84/DIG. 22

[58] Field of Search ..... 84/1.01, 1.03, 1.13, 84/1.17, 1.24, 1.26, DIG. 22

[56] References Cited

U.S. PATENT DOCUMENTS

| | | | |
|---|---|---|---|
| 3,247,310 | 4/1966 | Stinson, Jr. | 84/1.17 |
| 3,499,093 | 3/1970 | Munch, Jr. et al. | 84/1.24 |
| 3,715,442 | 2/1973 | Freeman | 84/1.01 |
| 3,745,225 | 7/1973 | Hall | 84/1.03 |
| 3,929,051 | 12/1975 | Moore | 84/1.17 |
| 3,971,283 | 7/1976 | Wayne, Jr. | 84/1.26 |
| 3,990,339 | 11/1976 | Robinson et al. | 84/1.17 |
| 4,012,702 | 3/1977 | Weber | 84/1.13 X |
| 4,065,993 | 1/1978 | Hirose | 84/1.03 |
| 4,108,037 | 8/1978 | Robinson et al. | 84/1.03 |
| 4,110,750 | 8/1978 | Heyning et al. | 84/1.01 X |
| 4,112,802 | 9/1978 | Robinson et al. | 84/1.01 |
| 4,147,085 | 4/1979 | Robinson et al. | 84/1.17 |
| 4,148,241 | 4/1979 | Morez et al. | 84/1.03 |

*Primary Examiner*—S. J. Witkowski

*Attorney, Agent, or Firm*—Ronald J. Kransdorf; Jack Kail

[57] ABSTRACT

A data encoder for use with a time multiplexed electronic organ or the like comprises a multiple stage shift register, means for simultaneously loading a predetermined pattern of logic bits in the shift register in response to a key down representative data pulse and means for coupling the output of the shift register to one of the data channels of the organ. In a first mode, the data encoder is operable as a fill-note generator wherein the shift register is loaded in response to an upper manual key down representative data pulse and lower manual key down representative data pulses are coupled to the upper manual data channel of the organ according to the output of the shift register. In a second mode, the data encoder is operable as a chimes generator wherein the shift register is loaded in response to an upper manual key down representative data pulse and the output of the shift register is coupled to the upper manual data channel of the organ. In a final mode, the data encoder is operable as a chord function generator wherein the shift register is loaded in response to a lower manual key down representative data pulse and the output of the shift register is coupled to the lower manual data channel of the organ.

21 Claims, 7 Drawing Figures

FIG. 1
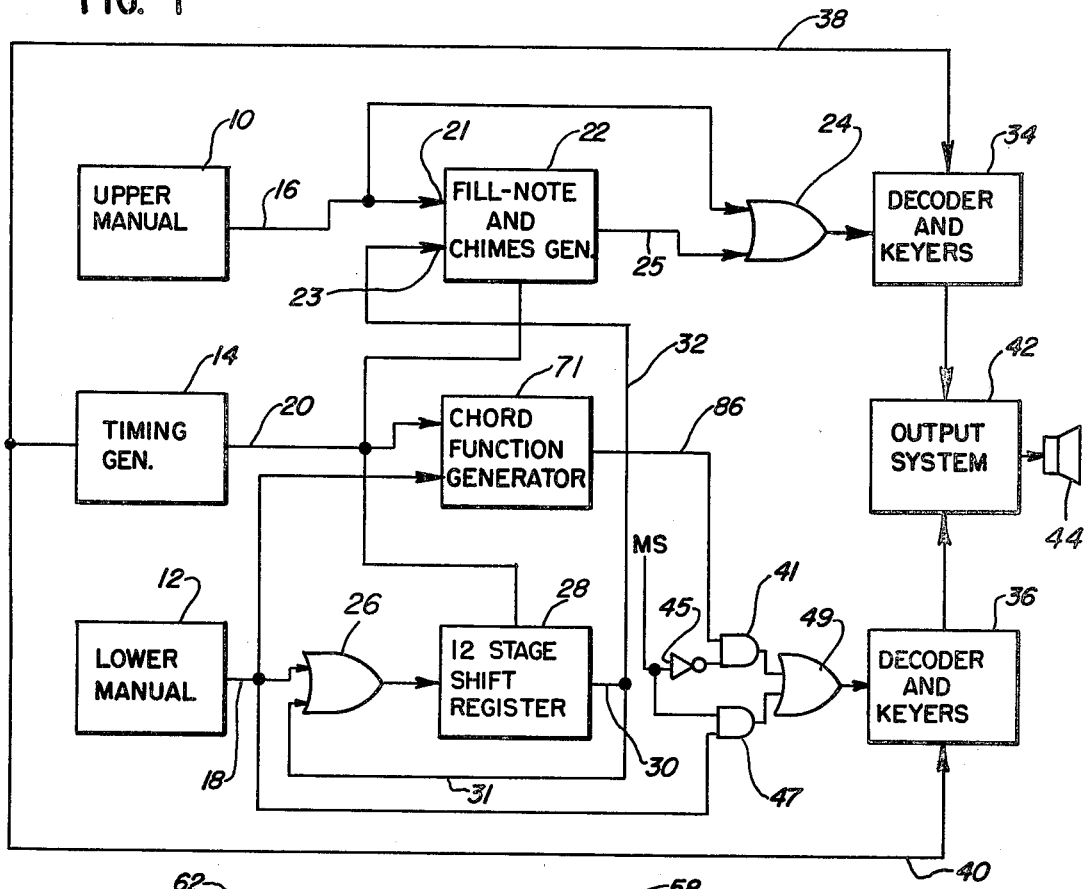
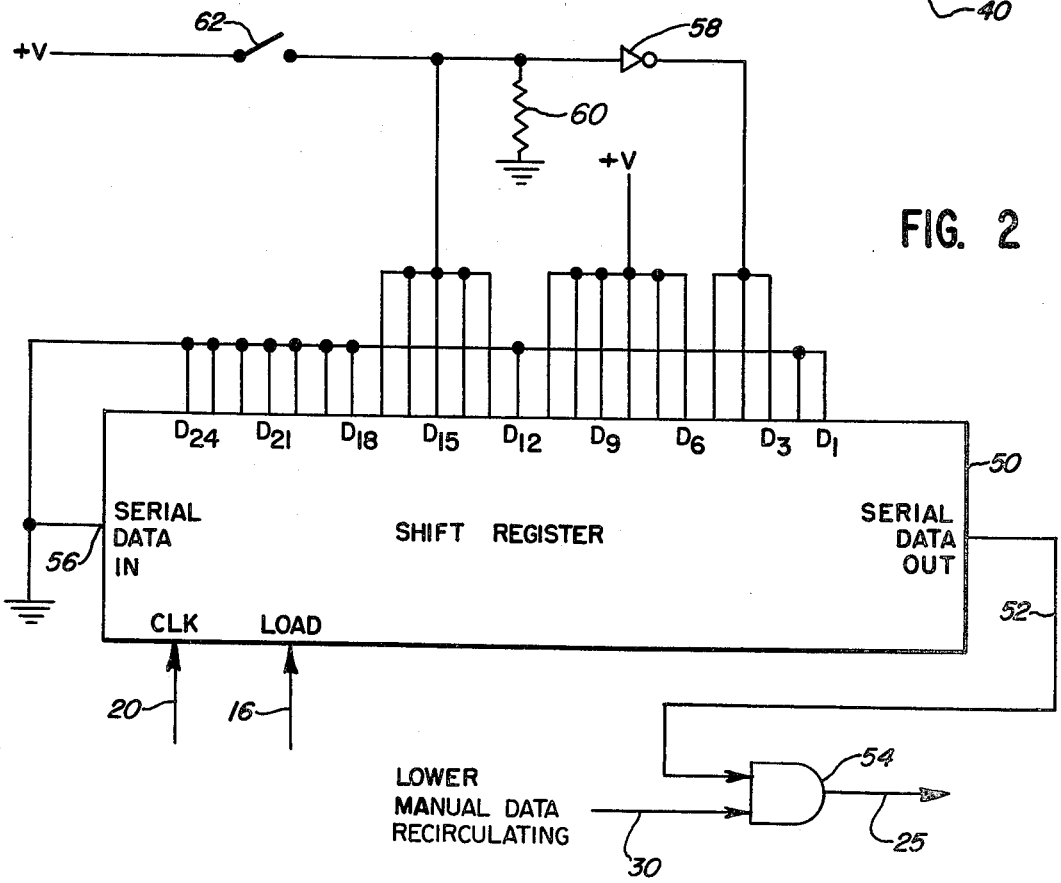
FIG. 2

FIG. 5
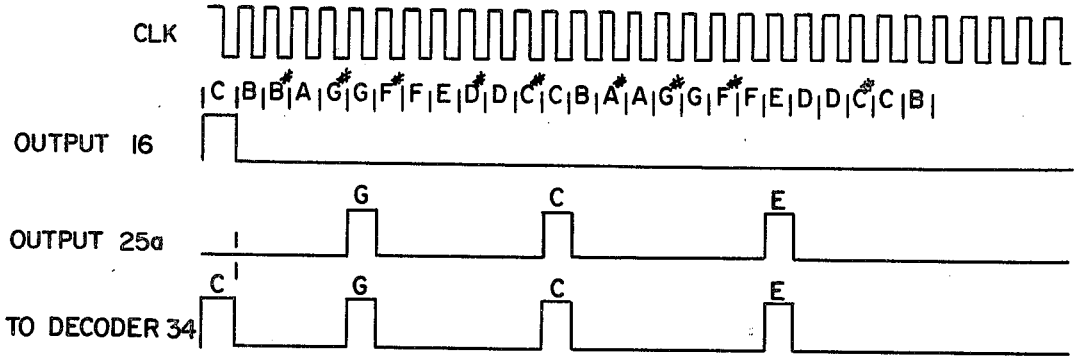
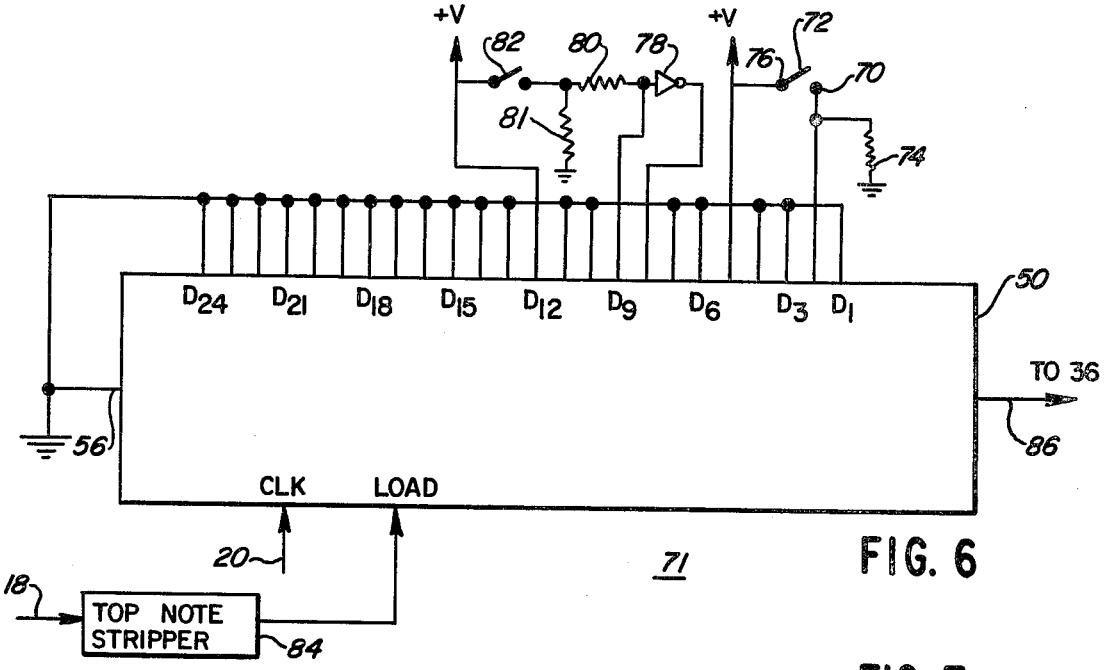
FIG. 6
FIG. 7
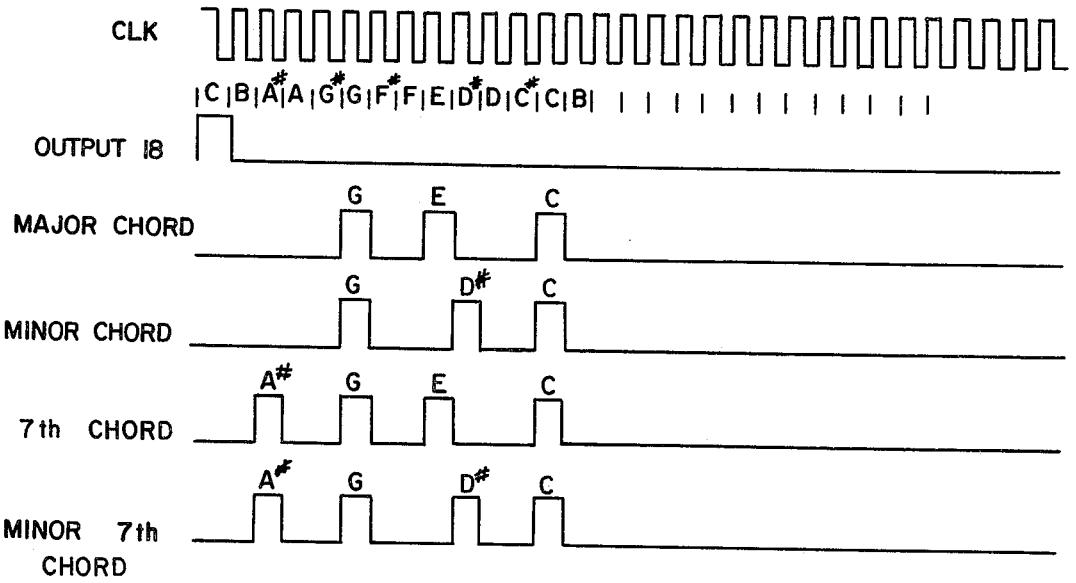

DATA ENCODER FOR AN ELECTRONIC MUSICAL INSTRUMENT

BACKGROUND OF THE INVENTION

The present invention relates to electronic musical instruments and more particularly to an improved data encoder for use with an electronic organ, the data encoder having embodiments operable as a fill-note generator, a chord function generator and a "chimes" generator.

A keyboard instrument such as an electronic organ typically includes an upper or solo keyboard manual, a lower or accompaniment keyboard manual, a tone generator, a plurality of keyers coupling the tone generator to voice formant means which, in turn, are connected through an amplifier to a speaker. The keyers are operable in response to depressed keys on the keyboard manuals for supplying appropriate tone signals from the tone generator to the voice formant means and amplifier for sounding through the speaker. In addition, modern day electronic organs frequently utilize a time multiplexing mode of operation wherein the keys of one or both manuals are continuously scanned for developing encoded, time multiplexed serial data streams identifying the depressed keys of the respective keyboards. A demultiplexer subsequently decodes the data streams for enabling actuation of the appropriate keyers.

Various specialized circuits have been developed in the past for increasing the flexibility of and the ease with which such an organ may be played. Two such specialized circuits, the fill-note generator and the chord function generator, have gained particular popularity recently. Another such specialized circuit is commonly known as a "chimes" generator. All of these circuits have one basic feature in common; namely, augmenting or additional tone signals are generated internally by the organ in response to the depression of a key for creating a desired musical effect. Thus, a series of tone signals are processed by the organ even though only a single key is operated.

Prior art fill-note generators typically comprise means for automatically producing fill-in notes harmonizing with a melody note played on the upper keyboard manual, the fill-in notes being determined in accordance with a chord simultaneously played on the lower keyboard manual. Early implementations of such harmony generators were largely mechanical in nature requiring the provision of multiple switches simultaneously operative to close multiple conductive circuits and sometimes to open others, in response to depression of various keys of the keyboards. See, for example, U.S. Pat. No. 3,247,310 to H. B. Stinson, Jr.

Harmony of fill-note generators of electronic design were subsequently developed to overcome many of the deficiencies characterizing the prior art mechanical systems. The system disclosed in U.S. Pat. No. 3,745,225 to Hall is exemplary of such electronic designs. Even more recently, systems wholly digital in nature have been provided to perform the fill-note generating function. Exemplary of such systems are those disclosed in U.S. Pat. Nos. 3,939,051 to Moore and Pat. No. 4,112,802 to Robinson, et al. These digital systems generally operate on a time division multiplexed basis wherein a melody note played on the upper keyboard manual is represented by a single time displaced pulse and the fill-in harmonizing notes are represented by additional pulses coupled through the upper manual data channel and determined in conformity with a chord played on the lower keyboard manual.

Regardless of the type of system involved, i.e. whether mechanical, electronic or digital, various so-called "rules" dictated by musical considerations and preferences have evolved over the years governing the relationship between a melody note and the notes which may be utilized as fill-in notes for harmonizing therewith. Thus, in the case of closed harmony, the fill-in notes should be within the octave immediately below the melody note but not within two semitones thereof. In addition, there should be no octave doubling which would occur when a harmony note is generated exactly one octave below the melody note. The prior art systems all include means of one sort or another for operating in conformity with these "rules". In contradistinction to closed harmony, open harmony requires the sounding of fill-in notes in more than one octave below the melody note, with the closest fill-in note being no closer than five semitones from the melody note.

A "chimes" generator can be thought of as a very specific form of fill-note generator, the major difference being that the generated fill-in notes have a well defined relationship to the played melody note and are not determined in accordance with data supplied from the lower manual keyboard. As such, in response to the playing of an upper manual key, certain additional notes having a predetermined musical relationship to the melody note are automatically developed by the chimes generator and inserted in the upper manual data channel for enabling the production of a "chimes"-like tone.

Prior art fill-note generating systems are typically lacking in means for conveniently altering the relationship between a melody note and those notes from the lower manual keyboard selected for sounding through the upper manual data channel as harmonizing fill-in notes. Typically, only one such relationship is provided for, this relationship being alterable only by restructing the associated circuitry or, sometimes, by reprogramming certain memory circuits. Yet another problem characterizing prior art fill-note generating systems is the "muddying" effect produced when two or more rather closely spaced melody notes are played simultaneously. The foregoing results from the generation of too many fill-in notes and produces a close harmony or clashing effect which is highly unharmonious.

Chord function generators are also generally well known in the art and typically comprise means for automatically sounding a chord in response to the operation of a single key on the lower manual. Various circuits have been developed to perform this function, some exemplary embodiments of which are disclosed in U.S. Pat. Nos. 4,108,037 to Robinson et al., 4,065,993 to Hirose and 3,715,442 to Freeman. Yet another chord function generator is illustrated in U.S. Pat. No. 4,148,241.

In an effort to reduce the ultimate cost of an electronic organ, it is obviously desirable to provide circuits capable of being operated in more than one mode so that a number of features can be provided without significantly increasing the hardware costs associated with the instrument. Accordingly, it would be desirable to provide a data encoder which is capable of operation in a variety of modes so as to add to the versatility of the organ without significantly increasing its cost. In particular, it would be desirable to provide a data encoder having operational modes for producing the effects of a fill-note generator, a chord function generator and a "chimes" generator.

SUMMARY OF THE INVENTION

The data encoder of the present invention is operable in association with an electronic musical instrument, such as an electronic organ, of the type having upper and lower keyboard manuals scanned for producing time multiplexed data pulses in conformity with a scan clock signal in response to operator depressed keys. The musical instrument further includes an upper manual data channel for receiving the time multiplexed data pulses developed in response to the depression of upper manual keys and a lower manual data channel for receiving the time multiplexed data pulses representing depressed keys on the lower keyboard manual. Suitable decoding and output circuits are also provided for generating tones in conformity with the developed time multiplexed data pulses.

The data encoder, which is operable in various different modes, basically comprises a multiple stage shift register responsive to the scan clock signal, means for simultaneously loading one of a number of predetermined patterns of logic bits in the shift register in response to a key down representative data pulse and means for coupling the output of the shift register to one of the data channels of the instrument for enabling the generation of a desired musical effect. Depending upon the selected pattern of logic bits and the configuration of the coupling means, the data encoder is operable either as a fill-note generator, a "chimes" generator or a chord function generator.

When operating as a fill-note generator, the shift register is loaded in response to each upper manual data pulse with either one of two different predetermined logic bit patterns. Lower manual data pulses are gated to the upper manual data channel according to the output of the shift register. One of the two predetermined patterns of logic bits generates data pulses which form a closed harmonic structure, the other pattern producing an open harmonic structure.

In its "chimes" generator mode of operation, the shift register is also loaded in response to each key down representative upper manual data pulse. A particular pattern of logic bits is utilized such that the data pulses produced at the output of the shift register, when combined with the key down representative data pulse on the upper data channel, enables the generation by the organ of a "chimes"-like tone.

When operating as a chord function generator, the shift register is loaded with one of four different logic bit patterns, corresponding to the generation of a major chord, a minor chord, a seventh chord and a minor seventh chord. In all cases, the shift register is loaded with one of the patterns in response to the first developed lower manual key down representative data pulse and its output is coupled to the lower manual data channel. The data pulses introduced onto the lower manual data channel thereby generate the foregoing chords.

BRIEF DESCRIPTION OF THE DRAWINGS

FIG. 1 is a block diagram generally illustrating the data encoder of the invention as used in association with a time multiplexed electronic organ.

FIG. 2 is a schematic drawing illustrating the fillnote generator embodiment of the data encoder of the invention.

FIG. 5 shows a series of waveforms useful in illustrating the operation of the circuit of FIG. 4.

FIG. 6 is a schematic diagram illustrating the chord function generator embodiment of the data encoder of the invention.

FIG. 7 shows a series of waveforms useful in illustrating the operation of the circuit of FIG. 6.

DESCRIPTION OF THE PREFERRED EMBODIMENT

Figure 3:
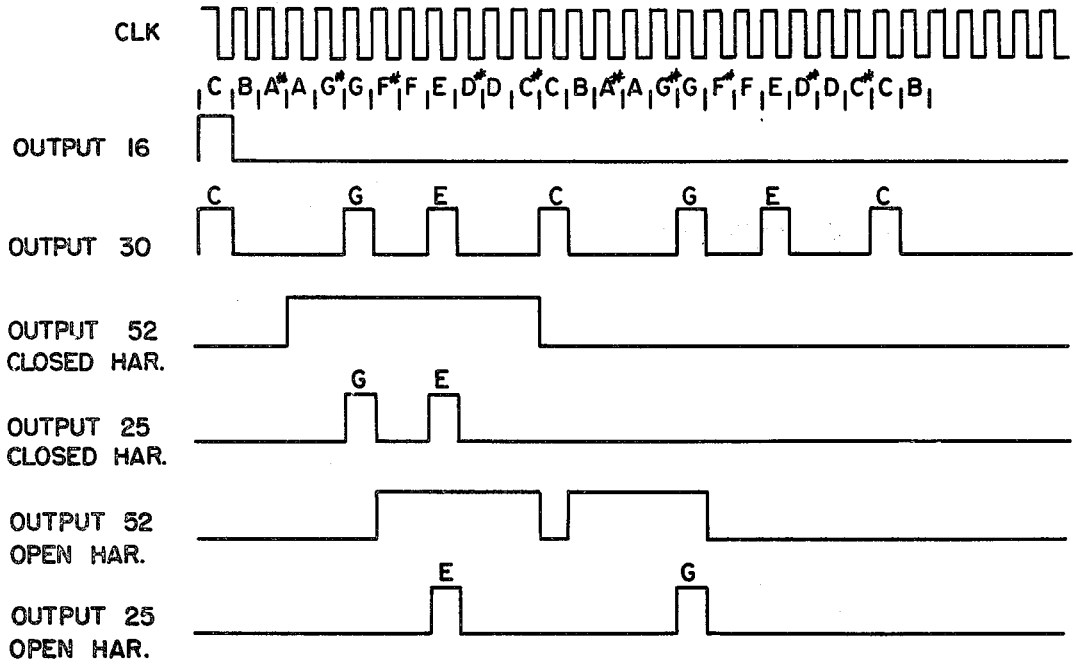
FIG. 3 shows a series of waveforms useful in illustrating the operation of the circuit of FIG. 2.

Referring to FIG. 1, which is a functional block diagram of an illustrative embodiment of the present invention, an electronic musical instrument such as an electronic organ includes an upper keyboard manual 10 and a lower keyboard manual 12. A timing generator 14 scans both upper keyboard manual 10 and lower keyboard manual 12 from top to bottom, i.e. from the keys corresponding to the highest pitched notes to the keys corresponding to the lowest pitched notes, for encoding the manuals by a time division multiplexing scheme into respective serial data streams. The foregoing is entirely conventional and will not be discussed in detail except to say that a serial data stream is developed on the output 16 of upper keyboard manual 10 consisting of a plurality of time displaced pulses defining the depressed keys of the upper keyboard manual. Similarly, a serial data stream is developed on the output 18 of lower keyboard manual 12 consisting of a plurality of time displaced pulses defining the depressed keys of the lower keyboard manual.

This time division multiplexing mode of operation is illustrated in graphical form in FIG. 3. Referring to FIG. 3, the top waveform represents the scan clock signal CLK developed at the output 20 of timing generator 14. Each period of the clock signal defines a respective time slot corresponding to the note associated with a particular key of each of the keyboard manuals 10 and 12. Thus, by way of example, the development of a pulse on either output 16 or 18 coinciding with the first period of the clock signal may represent the depression of a C-key on one of the manuals. In this case, depression of the following B-key on either manual would result in an output pulse coinciding with the second period of the clock signal, depression of the following A#-key in an output pulse coinciding with the third period of the clock signal, and so on. It will thus be seen that each note playable on the instrument is defined by a unique time slot associated with the scan clock signal produced by timing generator 14. The note defining time slots are repetitively generated enabling the keyboard manuals to be scanned on a continuous basis.

Returning now to FIG. 1, the upper keyboard manual serial data developed on output 16 is coupled to one input 21 of a fill-note and chimes generator 22 and to a first input of an OR gate 24, fill-note and chimes generator 22 comprising two embodiments of the data encoder of the invention. The lower keyboard manual serial data developed on output 18 is supplied to one input of a chord function generator 71 comprising a third embodiment of the data encoder of the invention, and is also coupled through an OR gate 26 to the input of a 12-stage shift register 28. Shift register 28 is operated in a recirculating mode wherein the signal developed on its output 30 is coupled back by a conductor 31 to its input via OR gate 26. Use of register 28 in this recirculating configuration normalizes the lower keyboard manual serial data by compressing it into a single octave wherein all octavely related lower manual keys are represented by the same time displaced pulse at the output 30 of the register. The signal developed on output 30 of shift register 28 is coupled to a second input 23 of generator 22 over a conductor 32.

The output 25 of generator 22 is coupled through OR gate 24 to an upper keyboard manual decoder and keyer matrix 34. The output 86 of chord function generator 71 is coupled to one input of an AND gate 41, AND gate 41 also being supplied with a signal $\overline{MS}$ through an inverter 45. The lower manual keyboard data developed on output 18 of lower manual 12 is coupled to the first input of a second AND gate 47, the second input of AND gate 47 being supplied with signal MS. The outputs of both AND gates 41 and 47 are coupled by an OR gate 49 to the input of a lower keyboard manual decoder and keyer matrix 36. It will be seen that if signal MS is logical 1, AND gate 47 is enabled for coupling data pulses from output 18 to decoder and keyer matrix 36 through OR gate 49 while AND gate 41 is inhibited. On the other hand, if signal MS is logical 0, AND gate 41 is enabled for coupling the output of chord function generator 71 to matrix 36 through OR gate 49 and AND gate 47 is inhibited. Thus, as determined by the logic state of signal MS, the signals developed on either output 18 or on output 86 are coupled to lower manual matrix 36 to the exclusion of the other.

Decoder and keyer matrices 34 and 36 receive timing signals from timing generator 14 over lines 38 and 40 respectively enabling the time multiplexed data developed on the output of OR gate 49 and on the output of OR gate 24 to be suitably decoded and keyed to an output system 41. Output system 42 is comprised of various conventional circuits, such as tone generators, filters, amplifiers and the like, operated in response to the decoded serial data for coupling appropriate audio signals to a speaker system 44 for conversion into audible tones.

In operation, it will be observed that the serial data representing the depressed upper manual keys is directly coupled from output 16 to decoder and keyer matrix 34 through OR gate 24. Also, depending on the state of signal MS, the serial data representing the depressed lower manual keys may be coupled directly from output 18 to decoder and keyer matrix 36 through AND gate 47 and OR gate 49. Moreover, and as will be fully described below, additional data pulses, augmenting the pulses developed on output 16, are coupled from the output of generator 22 through OR gate 24 to the input of decoder and keyer matrix 34. And, data pulses generated internally of chord function generator 71 may be coupled to decoder and keyer matrix 36 in lieu of the data pulses developed on output 18.

Fill-note and chimes generator 22 is operable in two different modes, a fill-note mode and a chimes mode. In either of these modes, the state of signal MS may be either logical 0 or logical 1. The configuration of generator 22 for operation in the fill-note mode is illustrated in FIG. 2. Referring therefore to FIG. 2, generator 22 comprises a 24-stage shift register 50 having a clock input connected for recieving the clock signal developed on output 20 of timing generator 14 and a parallel load enable input connected for receiving the upper keyboard manual serial data developed on output 16. Serial data developed at the output of shift register 50 is coupled over a conductor 52 to the first input of an AND gate 54, the second input of AND gate 54 being connected for receiving the lower manual recirculating data developed at the output 30 of shift register 28.

With further reference to FIG. 2, shift register 50 includes twenty-four inputs $D_1$-$D_{24}$ enabling a selected pattern of logic bits to be simultaneously loaded in the register in response to the development of a pulse on output 16. Inputs $D_1$, $D_2$, $D_{12}$ and $D_{18}$-$D_{24}$ together with the serial data input 56 of the shift register are connected to a source of ground potential (a logical 0 signal level) while inputs $D_6$-$D_{11}$ are connected to a source of positive potential (a logical 1 signal level). Inputs $D_3$-$D_5$ are connected to the output of an inverter 58 while inputs $D_{13}$-$D_{17}$ are connected to the input of the inverter. A harmony switch 62 selectively couples a source of positive potential (a logical 1 signal level) for application to the input of inverter 58 across a resistor 60. Thus, with switch 61 open as shown, its closed harmony position, the following pattern of logic bits is loaded into the shift register in response to the development of a pulse on output 16 of upper keyboard manual 10:

000000000000011111111100.

On the other hand, with switch 62 closed, its open harmony position, the following pattern of logic bits is loaded into the shift register in response to the development of a pulse on output 16 of upper keyboard manual 10:

000000011111011111100000.

Considering first the operation of fill-note generator 22 with harmony switch 62 on its closed harmony position, a pulse produced on output 16 of upper keyboard manual 10 in response to the playing of a key on that manual enables the first of the above described bit patterns to be loaded into shift register 50. Assuming that the depressed upper manual key is the C-key coinciding with the first clock period of the clock signal developed on output 20 of timing generator 14, the signal developed on output 16 may be represented by the second waveform shown in FIG. 3. After a one bit delay introduced by the loading of shift register 50, the contents of the register are shifted out onto conductor 52 in response to the clock signal. Thus, as represented by the fourth waveform illustrated in FIG. 3, the signal developed on conductor 52 is characterized by a logical 0 state during the two time slots occurring immediately after register 50 has been loaded, followed by a logical 1 state for the next nine time slots and then by a logical 0 state until the shift register received another load pulse. Assuming that a C chord is played on the lower keyboard manual 12, the recirculating lower manual data developed on output 30 of register 28, and coupled to the second input of AND gate 54 is represented by the third waveform illustrated in FIG. 3. Due to the combinatorial nature of AND gate 54, the signal produced on output 25 of fill-note generator 22 is then represented by the fifth waveform shown in FIG. 3. The signal developed on output 25, which comprises the closed harmony fill-notes, is combined with the melody note developed on output 16 by OR gate 24 and coupled to the input of decoder and keyer matrix 34 for processing.

With further reference to FIG. 3, it will be observed that the fill-notes developed on output 25 of generator 22 are in conformity with the previously mentioned "rules" for producing closed harmony. In particular, in the example shown in FIG. 3, a melody note having a pitch of C is played on the upper keyboard manual while a C chord consisting of the notes C, E and G is played on the lower keyboard manual. The logic signal developed on conductor 52 in association with AND gate 54 defines a window having a duration of nine time slots during which the lower manual recirculating data may be coupled from output 30 of register 28 to output 25 of fill-note generator 22. It will be observed that this window occurs two time slots after the melody note and is contained within the octave immediately following the melody note but not including the time slot of the next occurring C note. As a result, only the G and E notes within the octave immediately below the C melody note are coupled to the output 25 of the fill-note generator. The G and E fill-notes thus produced on output 25 are combined with the C melody note by OR gate 24 and coupled therefrom to decoder and keyer matrix 34.

Considering the case of open harmony, i.e. closing harmony switch 62, the second of the above described bit patterns is loaded into shift register 50 in response to the development of a data pulse on output 16 of upper keyboard manual 10. As a consequence, in response to the clock signal, the output 52 of register 50 is characterized by a logic signal conforming to the sixth waveform illustrated in FIG. 3. This waveform is characterized by a window whose opening is delayed by five time slots following the melody note and spans one complete octave but does not include the time slot associated with the note one octave below the melody note. Assuming again that a C chord is played on the lower manual keyboard, the fill-note pulses coupled to the output 25 of generator 22 comprise the pulses representing the note E in the octave immediately below the melody note. As before, the thusly produced fill-in notes are combined with the melody note by OR gate 24 and coupled to decoder and keyer matrix 34. It will be observed that open harmony is produced in that the fill-in notes are geneated in more than one octave below the melody note, with none appearing within five semitones of the melody note.

It will be appreciated that, whether generator 22 is operating in its open or closed harmony mode, each new upper manual data bit developed on output 26 reestablishes the gating window represented by the logic signal developed on conductor 52. As a result, the "muddying" effect characterizing some prior art fill-in note generators when two or more melody notes are simultaneously played is avoided. More specifically, assume that two melody notes C and D# are simultaneously played on the upper keyboard manual. Further assume that a G chord consisting of the notes G, D and B are played on the lower keyboard manual. In prior art systems, the first occurring melody note D# would properly inhibit the immediately two following time slots while enabling the next immediately following nine time slots for generating fill-in notes. Thus, the notes G, D and B would be generated as fill-in notes. However, the generation of a B fill-in note is inconsistent with the second melody note C, the fill-in note being within two semitones of the melody note. The present invention overcomes this problem by reestablishing the gating window in response to the second melody note, i.e. the C melody note, thereby inhibiting the generation of a B fill-in note.

Figure 4:
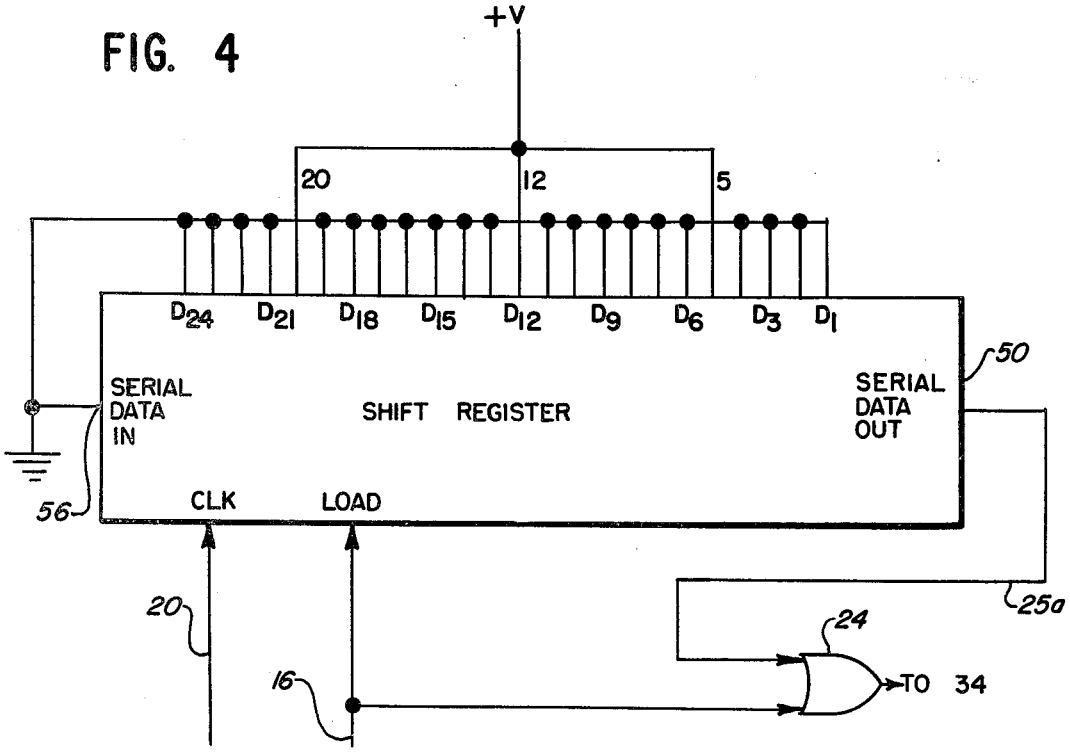
FIG. 4 is a schematic diagram illustrating the "chimes" generator embodiment of the data encoder of the invention.

FIG. 4 illustrates another embodiment of the invention wherein shift register 50 is utilized in a configuration for generating an open harmony chord having a "chimes"-like quality. Such chords are typically constituted of a melody note together with the notes having the following musical relationships therewith: the sub-fifth, the sub-octave and the sub-sub-third. The generation of such a "chimes" chord is achieved according to the invention by coupling inputs $D_5$, $D_{12}$ and $D_{20}$ of shift register 50 to a source of positive potential (a logical 1 signal level) while coupling the remaining inputs $D_1$–$D_4$, $D_6$–$D_{11}$ and $D_{13}$–$D_{24}$ to a source of ground potential (a logical 0 signal level). As in the case of the fill-note generator implementation of register 50 (see FIG. 2), serial data input 56 is also connected to the source of ground potential, the clock signal developed on output 20 of timing generator 14 is supplied to the clock input of the register and the parallel load enable input of the register is operated in response to upper keyboard manual data pulses developed on output 16 of upper manual 10. The output 25*a* of register 50 is coupled to one input of OR gate 24, the second input of OR gate 24 being supplied with the upper keyboard manual data pulses from output 16. It will thus be observed that, while in the fill-note generator embodiment of the invention, system operation is dependent upon the development of at least one data pulse on the upper manual output 16 representing a melody note together with the development of normalized lower manual data pulses on output 30 of recirculating shift register 28 representing a series of harmonizing or fill-in notes, in the "chimes" generator embodiment of FIG. 4, system operation is dependent only upon the existence of an appropriate melody note.

In operation, the development of a melody note representative data pulse on output 16 in response to the depression of an upper keyboard manual key, results in the following pattern of logic bits being simultaneously loaded in shift register 50:

000010000000100000010000.

Following the clock period during which the register is loaded, the loaded logic bits are shifted onto output 25*a* in response to the clock signal and combined with the melody note data pulse in OR gate 24. The combined data pulses are then coupled to decoder and keyer matrix 34 for operating output system 42 and speaker 44 for producing the "chimes"-like effect. In this regard, it will be appreciated that the particular logic bit pattern initially loaded in register 50 enables the gneration of pulses on output 25*a* having the requisite musical relationship to the melody note for producing a sound having the desired "chimes"-like quality.

FIG. 5 illustrates a specific example of the operation of generator 22 in its "chimes" mode of operation. Initially, assume that a data pulse is developed on output 16 of upper keyboard manual 10 in response to the depression of a C-key on the manual. This data pulse, which is represented by the second waveform of FIG. 5, causes the previously defined logic bit pattern to be loaded into shift register 50. Five clock periods later, a first data pulse is produced on output 25*a* representative of a G-note in the octave immediately below the C melody note (i.e. the sub-fifth of the melody note). Seven clock periods later, another data pulse is produced on output 25*a* this time representing a C-note exactly one octave below the melody note (the sub-octave of the melody note). Eight clock periods later, a final data pulse representative of an E-note in the second octave below the melody note (the sub-sub-third) is developed on output 25*a*. As represented by the last waveform of FIG. 5, the data pulses developed on output 25*a* are combined with the melody note and then coupled to decoder and keyer matrix 34 for operating output system 42 and speaker 44 for sounding the "chimes"-like tone.

A further embodiment of the invention wherein shift register 50 is operated as chord function generator 71 is illustrated in FIG. 6. In this mode of operation, signal MS is set at a logical 0 level so that only the output of chord function generator 71 is coupled to decoder and keyer matrix 36. As will be explained in detail below, the chord function generator embodiment of the invention is selectively operable for producing the major and minor chords of the note corresponding to a depressed key on the lower manual keyboard 12. Also, the flatted seventh interval of the diatonic scale can be added to either of these latter chords to produce a seventh chord or a minor seventh cord. In this regard, it will be recognized that a major chord consists of the root, major third and fifth of the tonic note while a minor chord consists of the root, minor third and fifth of the tonic note. A seventh chord is constructed by adding the flatted seventh interval of the diatonic scale to a major chord and a minor seventh chord is constructed by similarly adding the flatted seventh interval to a minor chord.

Referring now in detail to FIG. 6, the operation of shift register 50 for implementing chord function generator 71 is facilitated by coupling register inputs $D_1$, $D_3$–$D_4$, $D_6$–$D_7$, $D_{10}$–$D_{11}$ and $D_{13}$–$D_{24}$ together with serial data input 56 to a source of ground potential (a logical 0 signal level). Register input $D_2$ is coupled to one contact 70 of a seventh enable switch 72, contact 70 also being connected to ground potential through a coupling resistor 74. The second contact 76 of seventh enable switch 72 is connected to a source of positive potential and to the $D_5$ input of register 50. Register input $D_8$ is connected to the output of an inverter 78 whose input is connected to register inpt $D_9$. The input of inverter 78 is also connected through resistors 80 and 81 to a chord select switch 82, switch 82 being selectively operable for coupling a source of positive potential to the inverter. Finally, register input $D_{12}$ is directly connected to a source of positive potential. As in the previous embodiments of the invention, register 50 is operated in response to the clock signal developed on output 20 of timing generator 14. However, in this case, the load enable input of the register is coupled via a top note stripper circuit 84 to output 18 of lower keyboard manual 12 while the output 86 of the register is connected to the associated lower manual decoder and keyer matrix 36. Top note stripper 84 is a conventional circuit element operative for coupling the first, and only the first, data pulse developed on output 18 to the load enable input of register 50.

It will be appreciated that operation of switches 72 and 82 enable four distinct modes of operation of the circuit embodiment of FIG. 6. These four modes of operation correspond to the generation of a major chord and a minor chord together with the seventh and minor seventh chords of a tonic note selected by depressing the corresponding key of lower keyboard manual 12.

In the major chord mode of operation, both switches 72 and 82 are open such that, in response to a lower manual data pulse, the following pattern of logic bits is loaded in shift register 50:

000000000000100010010000.

In the minor chord mode of operation, switch 72 is open and switch 82 is closed such that, in response to a lower manual data pulse, the following pattern of logic bits is loaded in shift register 50:

000000000000100100010000.

In the seventh chord mode of operation, switch 72 is closed while switch 82 is open such that, in response to a lower manual data pulse, the following pattern of logic bits is loaded in shift register 50:

000000000000100100010010.

Finally, in the minor seventh chord mode of operation, both switches 72 and 82 are closed such that, in response to a lower manual data pulse, the following pattern of logic bits is loaded in shift register 50:

000000000000100100010010.

Regardless of the mode of operation, following the clock period during which the register is loaded, the logic bits comprising the selected pattern are shifted onto output 86 of register 50 and coupled therefrom to lower manual decoder and keyer matrix 36. Decoder and keyer matrix 36 then operates output system 42 and speaker 44 for sounding a chord in conformity with the tonic note coupled to the load enable input of register 50 and the selected mode of operation as determined by the positions of switches 72 and 82. In this regard, it will be appreciated that each logic bit pattern corresponding to one of the modes of operation of register 50 will produce on output 86 a series of time displaced data pulses defining the notes comprising the associated chord in proper musical relationship to the tonic note selected by depressing a key on lower keyboard manual 12.

FIG. 7 illustrates the operation of the chord function generator embodiment of the invention. Initially, assume that a data pulse representing a C-tonic note is developed on output 18 of lower keyboard manual 12 in response to the depression of a C-key on the manual. This data pulse, which is represented by the second waveform of FIG. 7 causes one of the four previously defined logic bit patterns to be loaded into shift register 50. Assume that the logic bit pattern associated with the major chord mode of operation is loaded into the register. Thus, referring to the third waveform of FIG. 7, five clock periods after the register has been loaded, a first data pulse is produced on output 86 representative of a G-note in the octave immediately below the C-tonic note. Three clock periods later, another data pulse is produced on output 86 this time representing an E-note in the octave immediately below the tonic note. Finally, still four clock periods later, a final data pulse representative of a C-note one octave below the tonic note is developed on output 86. It will be recognized that the three notes thusly developed on output 86, G, E and C, define a major C chord as expected.

The fourth waveform shown in FIG. 7 represents the data pulses produced on output 86 when register 50 is operated in the minor chord mode with the same tonic note as before. In this case, the data pulses represent the notes G, D# and C which properly define a C minor chord. In an analogous manner, the final two waveforms represent the data pulses produced on output 86 when register 50 is operated in the seventh and minor seventh chord modes with the same tonic note. This time, the data pulses representing the notes A#, G, E and C define a seventh C chord while the data pulses representing the notes A#, G, D# and C define a minor seventh C chord.

Although the foregoing examples were couched in terms of a C tonic note initiating the generation of various varieties of C chords, it will be appreciated that such was done for exemplary purposes only and should not, in any way, be construed so as to limit the invention. Thus, for example, the development of a data pulse on output 18 of lower keyboard manual 12 representing a G-note in response to the depression of a G-key on the lower manual, would result in the analogous generation of G chords, a data pulse representing an A-note would result in the generation of A chords, and so on. Moreover, by varying the logic bit patterns used to load register 50, all other possible chords, including, such as, augmented chords, diminished chords, sixth chords, etc. can also be constructed according to the teachings of the invention.

While particular embodiments of the invention have been shown and described, it will be obvious to those skilled in the art that changes and modifications may be made without departing from the invention in its broader aspects. Thus, for example, it will be appreciated that, in the fill-note generator embodiment of the invention, a greater variety of windows than those actually shown may be utilized to achieve various diverse musical effects. Similarly, in the "chimes" generator embodiment, different logic bit patterns may be employed whereby a number of different sound effects may be realized. Also, suitable circuitry may be provided if desired to enable convenient switching between the various embodiments of the invention. Finally, it will be appreciated that other sequential memory devices may be used in place of shift register 50. For example, a random access memory device including suitable sequential addressing means could be substituted in place of the shift register. Therefore, the aim in the appended claims is to cover all such changes and modifications as fall within the true spirit and scope of the invention.

We claim:

1. In a musical instrument having an upper keyboard manual, a clock signal source and an upper manual data channel responsive to said clock signal for developing time multiplexed data pulses defining depressed keys on said upper manual, a chimes generator comprising:

a multiple stage shift register responsive to said clock signal and having a serial data output terminal;

means for simultaneously loading a predetermined pattern of logic bits in said shift register in response to one of said upper manual data pulses, said predetermined pattern of logic bits defining a sequence of data pulses adapted for producing a chimes-like tone; and means for coupling the output of said shift register to said upper manual data channel.

2. In a musical instrument having a lower keyboard manual, a clock signal source and a lower manual data channel responsive to said clock signal for developing time multiplexed data pulses defining depressed keys on said lower manual, a chord function generator comprising:

a multiple stage shift register responsive to said clock signal and having a serial data output terminal;

means for simultaneously loading in parallel format a predetermined pattern of logic bits in said shift register in response to the first developed of said lower manual data pulses; and means for coupling said serial data output terminal of said shift register to said lower manual data channel.

3. A chord function generator according to claim 2 wherein said means for loading comprises means operable for selectively loading one of a plurality of predetermined logic bit patterns in response to the first developed of said lower manual data pulses.

4. A chord function generator according to claim 3 wherein said means for loading includes means defining first, second, third and fourth predetermined patterns of logic bits for developing on said lower manual data channel first, second, third and fourth series of time multiplexed data pulses adapted for producing, respectively, a major chord, a minor chord, a seventh chord and a minor seventh chord.

5. In a musical instrument having upper and lower keyboard manuals, a clock signal source, an upper manual data channel responsive to said clock signal for developing time multiplexed data pulses defining depressed keys on said upper manual and a lower manual data responsive to said clock signal for developing time multiplexed data pulses defining depressed keys on said lower manual, a fill-note generator comprising:

a multiple stage shift register responsive to said clock signal and having a serial data output terminal;

means for simultaneously loading a predetermined pattern of logic bits in said shift register in response to each of said upper manual data pulses; and means for selectively coupling said lower manual data pulses to said upper manual data channel according to the output of said shift register.

6. A fill-note generator according to claim 5 wherein said means for loading comprises means operable for selectively loading one of a plurality of predetermined logic bit patterns in response to each of said upper manual data pulses.

7. A fill-note generator according to claim 6 wherein said means for loading includes means defining at least first and second predetermined patterns of logic bits, said first and second patterns cooperating with said means for coupling for developing on said upper manual data channel time multiplexed data pulses adapted for producing closed and open harmony respectively.

8. A fill-note generator according to claim 5 wherein said lower manual data channel includes a 12-bit recirculation shift register connected for normalizing said lower manual data pulses, said means for coupling comprising a logic gate responsive to the output of said shift register and said recirculating shift register.

9. A fill-note generator according to claim 8 wherein said logic gate comprising an AND gate.

10. In a musical instrument having upper and lower keyboard manuals, a clock signal source, an upper manual data channel responsive to said clock signal source for developing time multiplexed data pulses defining depressed keys on said upper manual and a lower manual data channel responsive to said clock signal source for developing time multiplexed data pulses defining depressed keys on said lower manual, the improvement comprising:

a sequential memory means responsive to said clock signal source and having a serial data output terminal for sequentially developing output pulses representing the contents of said memory means;

means responsive to the occurrence of one of said data pulses for simultaneously loading a predetermined pattern of logic bits in said sequential memory means, said predetermined pattern being defined independently of keys depressed on said upper and lower manuals; and means for coupling the output of said sequential memory means for enabling the generation of a desired musical effect.

11. The improvement according to claim 10 wherein said sequential memory means comprises a multiple stage shift register.

12. The improvement according to claim 11 wherein said means for loading comprises means operable in response to each of said upper manual data pulses and wherein said means for coupling comprises means for selectively coupling said lower manual data pulses to said upper manual data channel according to the output of said shift register.

13. The improvement according to claim 12 wherein said means for loading comprises means operable for selectively loading one of a plurality of predetermined patterns of logic bits in response to each of said upper manual data pulses.

14. The improvement according to claim 13 wherein said means for loading includes means defining at least first and second predetermined patterns of logic bits, said first and second patterns cooperating with said means for coupling for developing on said upper manual data channel time multiplexed data pulses adapted for producing at least two different harmonic structures.

15. The improvement according to claim 12 wherein said lower manual data channel includes a 12-bit recirculating shift register connected for normalizing said lower manual data pulses, said means for coupling comprising a logic gate responsive to the outputs of said shift register and said recirculating shift register.

16. The improvement according to claim 15 wherein said logic gates comprises an AND gate.

17. The improvement according to claim 10 wherein said means for loading comprises means operable in response to each of said upper manual data pulses and wherein said means for coupling comprises means for coupling the output of said sequential memory means to said upper manual data channel.

18. The improvement according to claim 17 wherein said means for loading includes means defining said predetermined pattern of logic bits for developing on said upper manual data channel time multiplexed data pulses adapted for producing a "chimes"-like tone.

19. The improvement according to claim 10 wherein said means for loading comprises means operable in response to selected lower manual data pulses and wherein said means for coupling comprises means for coupling the output of said sequential memory to said lower manual data channel.

20. The improvement according to claim 19 wherein said means for loading comprises means operable for selectively loading one of a plurality of predetermined logic bit patterns in response to the first developed of said lower manual data pulses.

21. The improvement according to claim 20 wherein said means for loading includes means defining first, second, third and fourth predetermined patterns of logic bits for developing on said lower manual data channel first, second, third and fourth series of time multiplexed data pulses adapted for producing, respectively, a major chord, a minor chord, a seventh chord and a minor seventh chord.

* * * * *